US006220917B1

(12) United States Patent
Nelson

(10) Patent No.: US 6,220,917 B1
(45) Date of Patent: Apr. 24, 2001

(54) BODY SUSPENDED AMUSEMENT SYSTEM

(76) Inventor: Webb Nelson, 19180 144th Ave. NE., Woodinville, WA (US) 98072

( * ) Notice: Subject to any disclaimer, the term of this patent is extended or adjusted under 35 U.S.C. 154(b) by 0 days.

(21) Appl. No.: 09/632,185

(22) Filed: Aug. 3, 2000

(51) Int. Cl.[7] ..... A63H 33/00

(52) U.S. Cl. ..... 446/27; 273/115; 273/412; 273/441; 472/133

(58) Field of Search ..... 273/109, 115, 273/412, 441; 446/26, 27, 28, 71; 472/133; 482/139, 110, 10, 44

(56) References Cited

U.S. PATENT DOCUMENTS

| | | | | |
|---|---|---|---|---|
| 1,120,497 | | 12/1914 | Hornberger | 446/27 |
| 2,654,973 | | 10/1953 | Lemelson | 446/27 |
| 3,074,205 | * | 1/1963 | Carter | 446/27 |
| 3,098,316 | | 7/1963 | McCarthy | 446/27 |
| 3,104,877 | | 9/1963 | Gross | 473/576 |
| 3,165,315 | | 1/1965 | Petrusek | 482/81 |
| 3,178,851 | | 4/1965 | Gage | 446/28 |
| 3,184,884 | * | 5/1965 | Petrucelli | 446/27 |
| 3,186,124 | | 6/1965 | Voss | 446/28 |
| 3,216,725 | | 11/1965 | Hing | 473/507 |
| 3,224,774 | | 8/1963 | Klotz | 473/576 |
| 3,254,444 | | 6/1966 | Paterson | 362/106 |
| 3,342,482 | | 9/1967 | Paolone | 482/110 |
| 3,901,505 | | 8/1975 | Gerechter | 446/412 |
| 3,946,518 | * | 3/1976 | Ylitalo | 273/109 X |
| 4,221,074 | * | 9/1980 | Gonzalez | 446/28 |
| 4,718,676 | * | 1/1988 | Collins | 273/412 X |
| 5,027,992 | * | 7/1991 | Murray | 446/27 X |
| 5,192,080 | * | 3/1993 | Duncan | 273/412 |
| 5,603,651 | | 2/1997 | Shure et al. | 446/16 |
| 5,676,622 | * | 10/1997 | McFarlane | 273/109 X |

* cited by examiner

*Primary Examiner*—John A. Ricci
(74) *Attorney, Agent, or Firm*—LaMorte & Associates

(57) ABSTRACT

An amusement device that includes a mounting assembly that is selectively attachable to a person's body. A mounting rod is provided that has a first end and a second end. The first end of the mounting rod engages the mounting assembly. As such, the mounting rod extends outwardly from the mounting assembly away from the body of the person wearing the mounting assembly. A plurality of coordination games are provided. Each of the coordination games can be selectively attached to the second end of the mounting rod. Accordingly, each of the coordination games can be selectively suspended from a player's body. The player plays the coordination game by moving his/her body in the area of the mounting assembly. If a player masters the skills needed to play one of the coordination games, the coordination game can be changed to maintain a degree of difficulty and amusement.

16 Claims, 2 Drawing Sheets

BODY SUSPENDED AMUSEMENT SYSTEM

BACKGROUND OF THE INVENTION

1. Field of the Invention

In general, the present invention relates to amusement devices that challenge a person's physical coordination and sense of timing. More particularly, the present invention is related to amusement devices that attach to the body and are manipulated without use of the hands or arms.

2. Description of the Prior Art

When a person grasps or manipulates another object, it is almost always done with the hands. As such, it is a physiological necessity that people develop good hand/eye coordination and dexterity. The degree of coordination of the hands and arms is usually vastly superior to that of any other major muscle group in the body.

Since physical coordination of muscle groups other than the hands and arms is typically undeveloped, it can be somewhat amusing to attempt to complete otherwise simple tasks using these muscle groups. It is also amusing to watch a person attempt to complete simple tasks using a muscle group other than those contained in the arms and hands. It is for these reasons that the prior art is replete with amusement devices that attach to the body at different points and provide simple tests of coordination and timing. The most famous of such prior art devices is the Hula Hoop, which is spun around the waist. Other prior art amusement devices that attach to the waist and test coordination are exemplified by U.S. Pat. No. 3,186,124 to Voss, entitled Peg And Hoop Exercising Toy; U.S. Pat. No. 3,342,482 to Paolone, entitled Waist Mounted Gyration Rod Recreational Device; U.S. Pat. No. 3,610,622, entitled, Hip-Toss Ball Game; and U.S. Pat. No. 3,224,774 to Klotz, entitled Ball And Paddle Device.

In addition to the waist, amusement devices have been developed that attach to the head and legs. Prior art amusement devices that are worn on the leg are exemplified by U.S. Pat. No. 3,165,315 to Petrusek, entitled Skipping Device and U.S. Pat. No. 5,603,651 to Shure, entitled Bubble-Producing Skipping Toy.

Prior art amusement devices that are worn on the head are exemplified by U.S. Pat. No. 3,098,316 to McCarthy, entitled Child's Toy and U.S. Pat. No. 3,216,725 to Hing, entitled Head Attached Balancing Toy.

A problem associated will all such prior art amusement devices, is that each time a person plays with the amusement device, that person develops his/her coordination through practice. After a short time, it is no longer challenging to complete the coordination test embodied by the amusement device. When the amusement device loses its challenge, it no longer is very amusing to play or watch.

A need therefore exists in the art for an amusement device that can be attached to a part of the body other than the arms and hands, yet can be selectively varied to present a variety of different challenges to the user. This need is met by the present invention as described and claimed below.

SUMMARY OF THE INVENTION

The present invention is an amusement device. The amusement device includes a mounting assembly that is selectively attachable to a person's body. The mounting assembly can be eyeglass frames, a hat, a head band, a body band or the like. A mounting rod is provided that has a first end and a second end. The first end of the mounting rod engages the mounting assembly. As such, the mounting rod extends outwardly from the mounting assembly away from the body of the person wearing the mounting assembly. A plurality of coordination games are provided. Each of the coordination games can be selectively attached to the second end of the mounting rod. Accordingly, each of the coordination games can be selectively suspended from a player's body. The player plays the coordination game by moving his/her body in the area of the mounting assembly. If a player masters the skills needed to play one of the coordination games, the coordination game can be changed to maintain a degree of difficulty and amusement.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
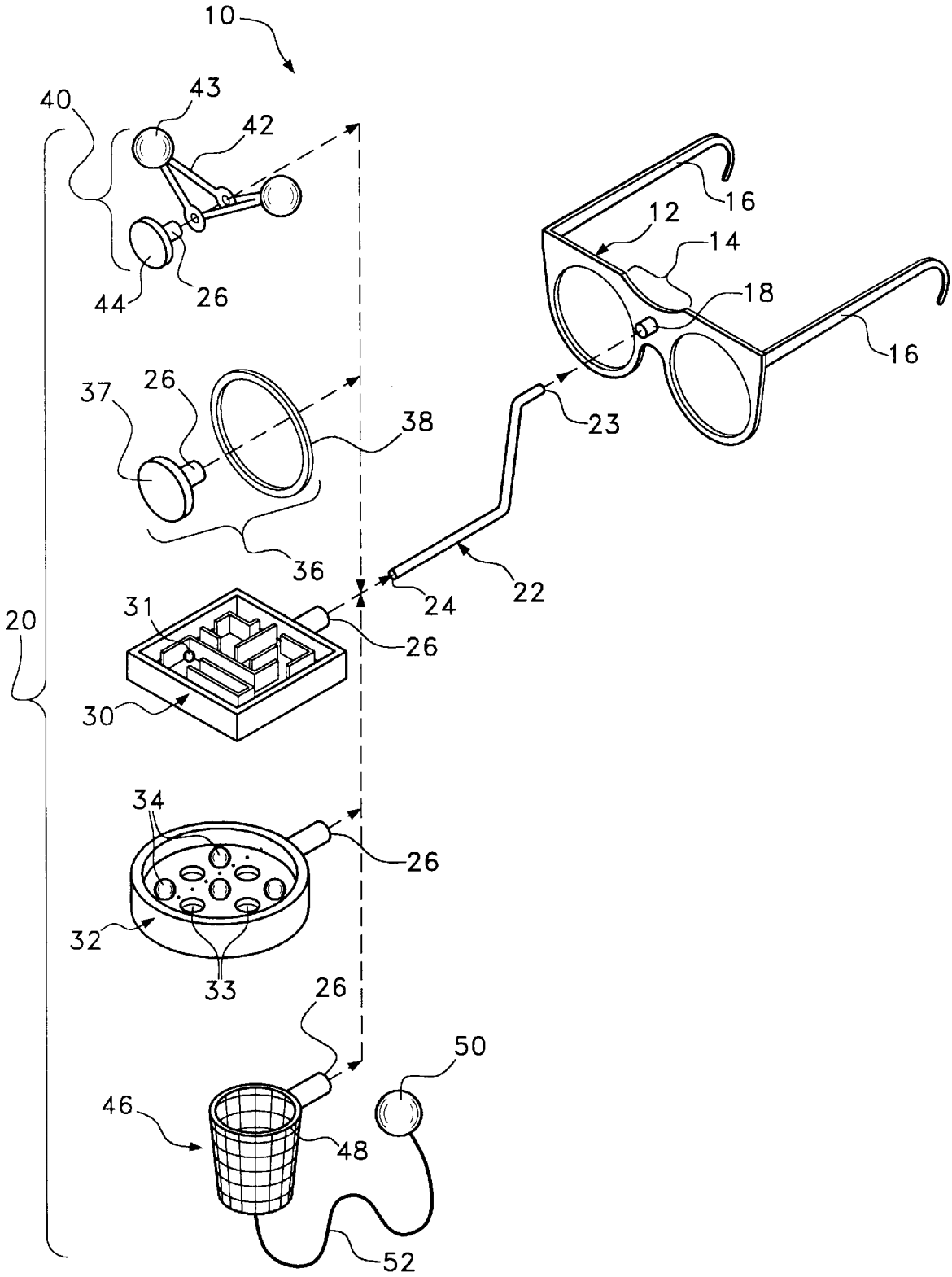
FIG. 1 is a perspective view of an amusement system in accordance with the present invention that illustrates a variety of coordination games.

Referring to FIG. 1, there is shown an amusement system 10 in accordance with the present invention. The exemplary embodiment of the amusement system 10 includes a pair of eyeglass frames 12. The eyeglass frames 12 contain a bridge region 14 that extends across the top of the nose and two temple elements 16 that extend over the ears. A mounting hole 18 is formed through the bridge area 14 directly above the nose.

The eyeglass frames 12 are worn on the head in a conventional manner, wherein the bridge area 14 is positioned over the nose and the temple elements 16 pass over the ears. The eyeglass frames 12 can contain lenses, however, lenses are not required. As will later be explained, in certain embodiments, lenses may be preferred to protect the eyes from inadvertent contact.

The amusement system 10 consists of a variety of physical coordination games 20 that attach to the eyeglass frames 12 via the mounting hole 18 in the bridge area 14. Each of the coordination games 20 connect to the eyeglass frames 12 via a mounting rod 22. The first end 23 of the mounting rod 22 is free and is both shaped and sized to engage the mounting hole 18 in the eyeglass frame 12. The interconnection between the first end 23 of the mounting rod 22 and the mounting hole 18 can be made via an interference fit, a keyed hole interconnection or a threaded interconnection. In the shown embodiment, a keyed hole interconnection is shown, wherein both the mounting rod 23 and mounting hole 18 are asymmetrically formed and interconnect in only one orientation.

The second end 24 of the mounting rod 22 engages a connector port 26 that extends from part of each of the coordination games 20. The connector port 26 on each coordination game 20 is a cylindrical structure that defines an opening through which the second end 24 of the mounting rod 22 passes. The interconnection between the second end 24 of the mounting rod 22 and the hole in the connector port 26 can also be made via an interference fit, a keyed hole interconnection or a threaded interconnection.

A wide variety of coordination games 20 can be attached to the second end 24 of the mounting rod 22. A coordination game 20, for the purposes of this disclosure, is defined as any game or activity that requires controlled coordinated movements and/or timing in order to achieve an end goal. Examples of some coordination games 20 are shown in FIG. 1. In FIG. 1, there is a maze game 30. The maze game 30 requires that a ball 31 be moved through the maze from one end of the maze to the other. The maze 30 connects to the mounting rod 22 and the eyeglass frames 12, via the connector port 26. As such, the maze 30 is moved by the controlled movements of a person's body, neck and head.

A second coordination game shown is an aperture maze game 32. In this coordination game, a game board is provided that contains a plurality of apertures 33. A plurality of balls 34 are provided on the game board. The object of the game is to manipulate the maze game 32 so that the different balls 34 come to rest in the different apertures 33. The maze game 32 connects to the mounting rod 22 and the eyeglass frames 12, via a connector port 26. As such, during play, the maze game 32 is moved by the controlled movements of a person's body, neck and head.

A third coordination game shown is a spinning hoop game 36. In this coordination game, the second end 24 of the mounting rod 22 engages the connector port 26, which is part of an enlarged cap 37. A hoop 38 is then placed around the mounting rod 22. The object of the spinning hoop game 36 is to continuously spin the hoop 38 around the mounting rod 22, wherein the en d cap 37 prevents the hoop 38 from falling off the mounting rod 22. The mounting rod 22 is connected to the eyeglass frames 12. As such, during play, the movement of the hoop 38 is governed by the controlled movements of a person's body, neck and head.

A fourth coordination game 40 shown is set of clackers. Clackers is the name used in the toy industry to define a game of colliding rotating spheres. In this coordination game 40, two rotational arm elements 42 are connected to the mounting rod 22. The rotational arm elements 42 contain round ball weights 43 at their far ends. The rotational arm elements 42 are prevented from sliding off the mounting rod 22 by an enlarged end cap 44. The object of the game is to move the mounting rod 22 up and down so that the ball weights 43 continuously rotate in opposite directions and collide with one another. The mounting rod 22 is connected to the eyeglass frames 12. As such, during play, the rotating arm elements 42 are moved by the controlled movements of a person's body, neck and head.

The fifth coordination game shown is a tethered ball game 46. I n this coordination game, a hoop structure 48 is attached to the second end of the mounting rod, via the connector port 26. A ball 50 is connected to the hoop structure 48 with a tether 52. The object of the game is to manipulate the hoop structure 48 so as to cause the tethered ball 50 to land in the hoop structure 48. The ho op structure 48 connects to the mounting rod 22 and the eyeglass frames 12. As such, during play, the hoop structure 48 is moved by the controlled movements of a person's body, neck and head.

The five different coordination games 20 illustrated in FIG. 1 are merely exemplary and it should be understood that many other similar coordination games can be adapted for use with the present invention. If the game includes a tethered ball or any other object that can possibly contact a player's eye, it is desired to lace lenses in the eyeglass frames. In this manner, the eyeglass frames not only support the coordination games but provide protection to the player's eyes.

Figure 2:
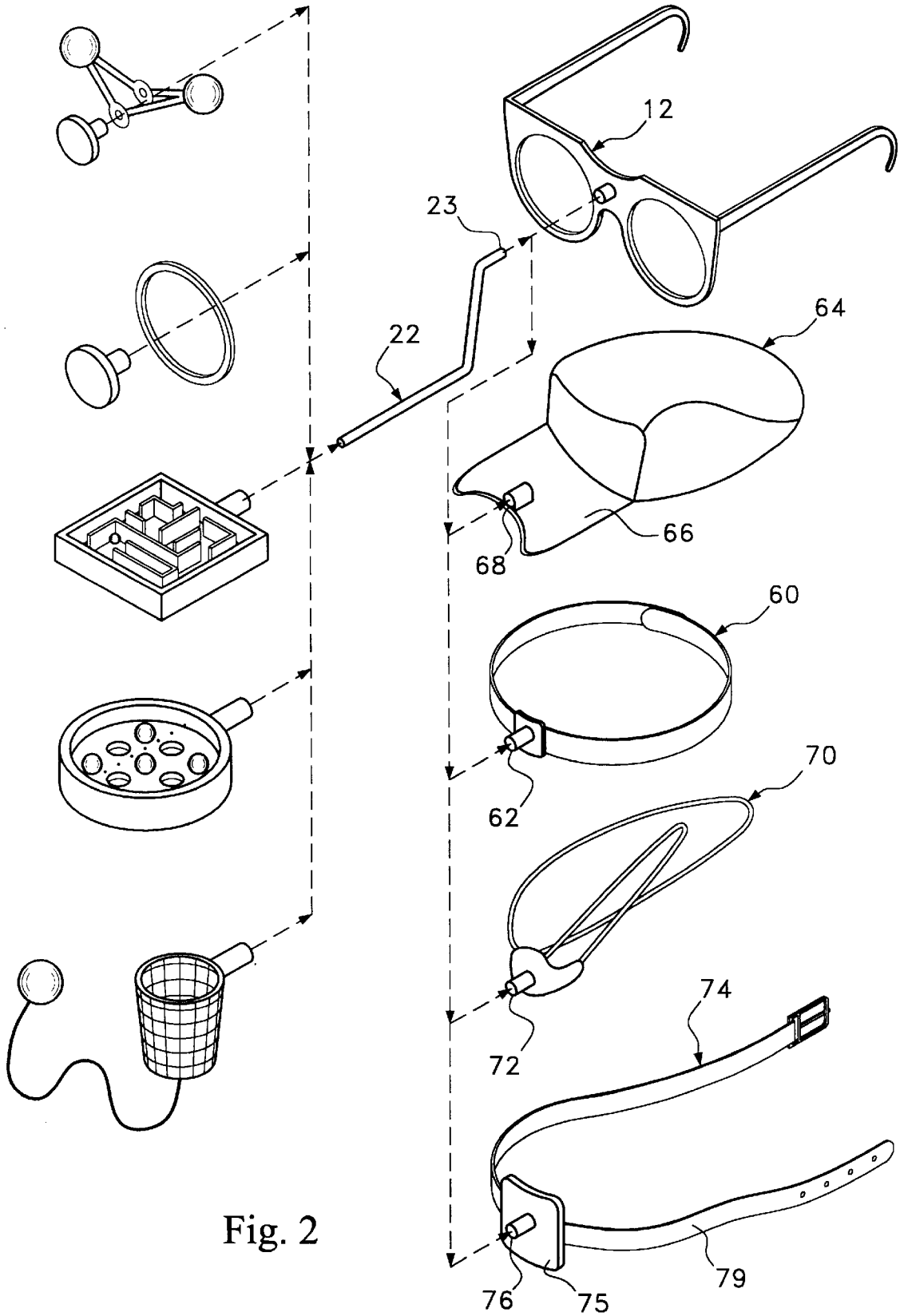
FIG. 2 is a perspective view of an amusement device in accordance with the present invention that illustrates a variety of coordination games and a variety of body engagement devices.

In FIG. 1, all of the coordination games 20 attached to a pair of eyeglass frames 12. As such, all manipulation of the ordination games 20 comes from the movements of the head on which the eyeglasses 12 are worn. The use of eyeglasses 12 is also exemplary. Other means of connecting the mounting rod 22 to the body can also be used. Referring to FIG. 2, the eyeglass frames 12 previously described are shown. Also shown are substitutes for the eyeglass frames 12. Among the substitutes include a head band 60 that can be worn around the head. The head band 60 contains a mounting hole 62 that accepts the first end 23 of the mounting rod 22 in the same manner as the eyeglass frames 12.

Similar to the head band 60 is a hat 64 that can be worn on the head. The hat 64 contains a sun shade 66. A mounting hole 68 is manufactured in the sun shade 66. The mounting hole 68 accepts the mounting rod 22 in the same manner as the eyeglass frames 12 originally described.

Also in FIG. 2, is shown a chin strap 70 that is worn on the chin. The chin strap 70 contains a mounting hole 72 that accepts the first end 23 of the mounting rod 22 in the same manner as the eyeglass frames 12.

Lastly, in FIG. 2, a body strap assembly 74 is shown. The body strap assembly 74 includes a mounting plate 75 in which a mounting hole 76 is formed. The mounting hole 76 accepts the first end 23 of the mounting rod 22 in the same manner as the eyeglass frames 12. The mounting plate 75 is connected to a strap 79. The strap 79 can be secured around the waist, arm, leg or any other part of the body.

It will be understood that the embodiments of the present invention amusement system that are described and illustrated herein are merely exemplary and a person skilled in the art can make many variations to the embodiment shown without departing from the scope of the present invention. All variations, modifications and alternate embodiments that serve the stated function are intended to be included within the scope of the present invention as defined by the appended claims.

What is claimed is:

1. An amusement device, comprising:

eyeglass frames;

a mounting rod extending outwardly from said eyeglass frames; and a coordination game supported by said mounting rod.

2. The device according to claim 1, wherein said eyeglass frames contain a bridge and said mounting rod extends outwardly from said bridge.

3. The device according to claim 1, wherein said coordination game is selected from a group of games that include maze games, spinning hoop games, tethered ball games and rotating colliding ball games.

4. The device according to claim 1, wherein said coordination game is selectively detachable from said mounting rod.

5. The device according to claim 1, wherein said coordination game is selectively detachable from said eyeglass frames.

6. An amusement device, comprising:

a mounting assembly selectively attachable to a person's body;

a mounting rod having a first end and a second end, wherein said first end engages said mounting assembly and said second end extends outwardly from said mounting assembly; and a plurality of coordination games selectively attachable to said second end of said mounting rod.

7. The device according to claim 6, wherein said mounting assembly includes a pair of eyeglass frames.

8. The device according to claim 6, wherein said mounting assembly includes a hat.

9. The device according to claim 6, wherein said mounting assembly is selected from a group consisting of hats, eyeglasses, head bands, chin bands and body bands.

10. The device according to claim 6, wherein said plurality of coordination games is selected from a group consisting of maze games, tethered ball games, spinning hoop games, and colliding ball games.

11. The device according to claim 10, wherein each of said plurality of coordination games contains a mounting connector capable of selectively engaging said second end of said mounting rod.

12. An amusement device, comprising:

a mounting assembly wearable on the head of a user;

a mounting rod having a first end and a second end, wherein said first end of said mounting rod is selectively connectable to said mounting assembly;

a plurality of games, each of said games having a connector thereon that is adapted to selectively receive and engage said second end of said mounting rod, thereby enabling each of said games to be supported by said mounting rod from said mounting assembly one at a time.

13. The device according to claim 12, wherein said mounting assembly includes a pair of eyeglass frames.

14. The device according to claim 12, wherein said mounting assembly includes a hat.

15. The device according to claim 12, wherein said mounting assembly is selected from a group consisting of hats, eyeglasses, head bands, chin bands and body bands.

16. The device according to claim 12, wherein said plurality of coordination games is selected from a group consisting of maze games, tethered ball games, spinning hoop games, and colliding ball games.

* * * * *